US007740147B1

(12) United States Patent
Gilbert

(10) Patent No.: US 7,740,147 B1
(45) Date of Patent: Jun. 22, 2010

(54) BALL AND SOCKET CLOSING LID

(75) Inventor: Tyler Sean Gilbert, Bellevue, WA (US)

(73) Assignee: Pacific Market International, LLC, Seattle, WA (US)

( * ) Notice: Subject to any disclaimer, the term of this patent is extended or adjusted under 35 U.S.C. 154(b) by 537 days.

(21) Appl. No.: 11/670,917

(22) Filed: Feb. 2, 2007

(51) Int. Cl.
*B65D 51/18* (2006.01)

(52) U.S. Cl. ..... 220/254.3; 220/711; 220/810

(58) Field of Classification Search ..... D7/619.1; 16/224; 206/217; 215/228, 235, 306; 220/254.1, 220/254.3, 254.4, 254.7, 711, 713, 810, 817, 220/818, 819, 822, 831, 833, 836, 291; 222/556; *B65D 51/18*

See application file for complete search history.

(56) References Cited

U.S. PATENT DOCUMENTS

| | | | | | |
|---|---|---|---|---|---|
| 3,059,816 | A | * | 10/1962 | Goldstein | 222/109 |
| 3,964,631 | A | | 6/1976 | Albert | |
| 3,967,748 | A | | 7/1976 | Albert | |
| 3,972,443 | A | | 8/1976 | Albert | |
| 4,094,433 | A | * | 6/1978 | Numbers | 220/715 |
| 4,099,642 | A | | 7/1978 | Nergard | |
| 4,190,173 | A | | 2/1980 | Mason et al. | |
| 5,141,138 | A | * | 8/1992 | Odet et al. | 222/153.07 |
| 5,249,703 | A | | 10/1993 | Karp | |
| 5,680,951 | A | | 10/1997 | Faltman, III et al. | |
| 5,975,093 | A | * | 11/1999 | Joulia | 132/293 |
| 6,070,749 | A | * | 6/2000 | Joulia | 220/4.22 |
| 6,702,137 | B1 | * | 3/2004 | Kowa et al. | 220/254.5 |
| 6,763,964 | B1 | | 7/2004 | Hurlbut et al. | |
| 7,186,918 | B2 | * | 3/2007 | Swenson et al. | 174/66 |

* cited by examiner

*Primary Examiner*—Anthony Stashick
*Assistant Examiner*—Brett Edwards
(74) *Attorney, Agent, or Firm*—Davis Wright Tremaine LLP; George C. Rondeau, Jr.

(57) ABSTRACT

A cover assembly for a beverage container includes a ball and socket assembly having a ball member and a corresponding socket member. The socket member includes extendable arms that engage the ball member. The ball and socket assembly permits the cover to be polyaxially rotated with respect to the beverage container. The cover is rotatable from a closed position, where the cover is seated against the beverage container, to a variety of open positions, where the cover can be rotated out of view from a user drinking from the beverage container. The ball and socket assembly, in addition, may be configured to maintain the cover in a variety of open positions relative to the beverage container without auxiliary support or assistance.

20 Claims, 3 Drawing Sheets

BALL AND SOCKET CLOSING LID

TECHNICAL FIELD

This invention relates generally to covers, caps, lids, or cover assemblies for a beverage container such as a travel coffee mug or a thermally insulated drinking vessel. Specifically, the invention relates to moveable lids or covers for beverage containers.

BACKGROUND OF THE INVENTION

Beverage containers, thermally insulated and other types, have become increasingly popular with the public for use with hot beverages, such as coffee, or with cold beverages. Hot beverages impose the most demanding thermal requirements on a beverage container while cold beverages typically place a lower thermal load on the beverage containers. One type of insulated beverage container has sidewalls manufactured from metal, particularly stainless steel, to withstand the high thermo-mechanical loading. Another type of insulated beverage container is manufactured with a plastic double wall, wherein the interstitial space between the inner and outer walls is filled with air, a foamed material, or some combination thereof.

A conventional beverage container is typically covered with a cover, a lid, a cap, or some combination of the above to reduce heat loss from the container and to reduce the likelihood of the beverage in the container spilling. One example of a beverage container covered with a lid is described in U.S. Pat. No. 5,249,703 to Karp. Karp discloses a travel mug comprising a container and a lid in combination. The container includes a handle and an annular lip extending from an inner surface of the container. The lid includes a body having a perimeter sized to form a seal with a portion of the annular lip. The lid includes a cylindrical well with a vertical dividing wall that permits the lid to be rotated by hand. Two retaining arms extend from the underside of the lid and engage the annular lip to couple the lid with the container. The container includes diametrically opposed gaps in the annular lip that operate as passageways for the retaining arms. The lid, in turn, further includes diametrically opposed notches that are alignable with the gaps in the annular lip to permit drinking from the otherwise sealed container. One drawback of the travel mug described by Karp is that the container must be specially manufactured with dedicated structure (i.e., the annular lip) to engage the arms of the lid.

Another example of a beverage container with a cover is described in U.S. Pat. No. 5,680,951 to Feltman, III, et al. (Feltman). Feltman describes a cover comprising a cap and a lid. The cap includes an inner groove to retain the cap on the container. The lid is rotatably mounted in the cap with a ring fitting that engages a complementary ring in the cap. Yet another example of a beverage container is described in U.S. Pat. No. 4,190,173 to Mason, et al. (a dispensing assembly with two spaced, thermally insulating dispensing members rotatably mounted to one another and where one of the dispensing members engages the beverage container).

In addition, other examples of drinking receptacles with covers, lids, caps, or the like are described in U.S. Pat. No. 3,67,748 to Albert (describing a cover with a poppet valve), U.S. Pat. No. 3,964,631 to Albert (describing a cover with a finger-operated valve), and U.S. Pat. No. 4,099,642 to Nergard (describing a cover with a valve assembly). In these descriptions, the valve is moveable to an open position, which permits removal of the beverage from the container, and moveable to a closed position, which substantially maintains the beverage within the container. In the aforementioned containers, the respective covers, lids, caps, and the like have numerous components generally arranged in a fairly complex assembly. Hence, one drawback of these containers is that the covers, lids, caps, and/or the like include numerous pockets, recesses, corners, and other interstitial zones that are often difficult to clean and thus maintain in a hygienic condition.

Yet another type of beverage container and cover combination is described in U.S. Pat. No. 6,763,964 to Hurlbut et al. (Hurlbut) assigned to the assignee of the present invention. Hurlbut describes a lid with a rocker arm that is moveable between an open and a closed position. The lid attaches to the beverage container and includes both drinking and venting apertures and respective basins or recesses formed in the lid. The rocker arm includes venting and drinking seals for sealing the respective apertures in the lid when the rocker arm is in the closed position. The rocker arm is detachable from the lid to facilitate cleaning of the lid and the rocker arm. When drinking a beverage from the container, the rocker arm is rotatable from its closed position to its open position about only a single axis. The cover disclosed by Hurlbut is extremely successful with respect to user ergonomics, hygiene, fluid integrity, etc. However, it is somewhat expensive to manufacture.

Consequently, there is need for a beverage container with a covering device that overcomes at least some of the aforementioned drawbacks.

SUMMARY OF THE INVENTION

It is therefore one object of the present invention to provide a cover assembly for an insulated beverage container, which is easy to use and maintain, which is leak proof, and which is relatively inexpensive to manufacture. The invention achieves the above objects, as well as other objects and advantages, by providing a cover and/or a cover assembly for a beverage container or similar receptacle. A ball and socket assembly couples the cover to the beverage container and allows the cover to be polyaxially rotatable with respect to the beverage container. By way of example, a socket member extends from the cover and rotationally engages a ball member that extends from the beverage container. The socket member may include extendable and biasly separable arms. Once the ball member is coupled to the socket member, the cover is moveable from a closed position to a variety of open positions. In addition, an amount of friction within the ball and socket assembly enables the cover to be maintained in the variety of open positions with respect to the beverage container without auxiliary support or assistance.

BRIEF DESCRIPTION OF THE DRAWINGS

Preferred and alternative embodiments of the present invention are described in detail below with reference to the following drawings.

DETAILED DESCRIPTION OF THE PREFERRED EMBODIMENT

Figure 1:
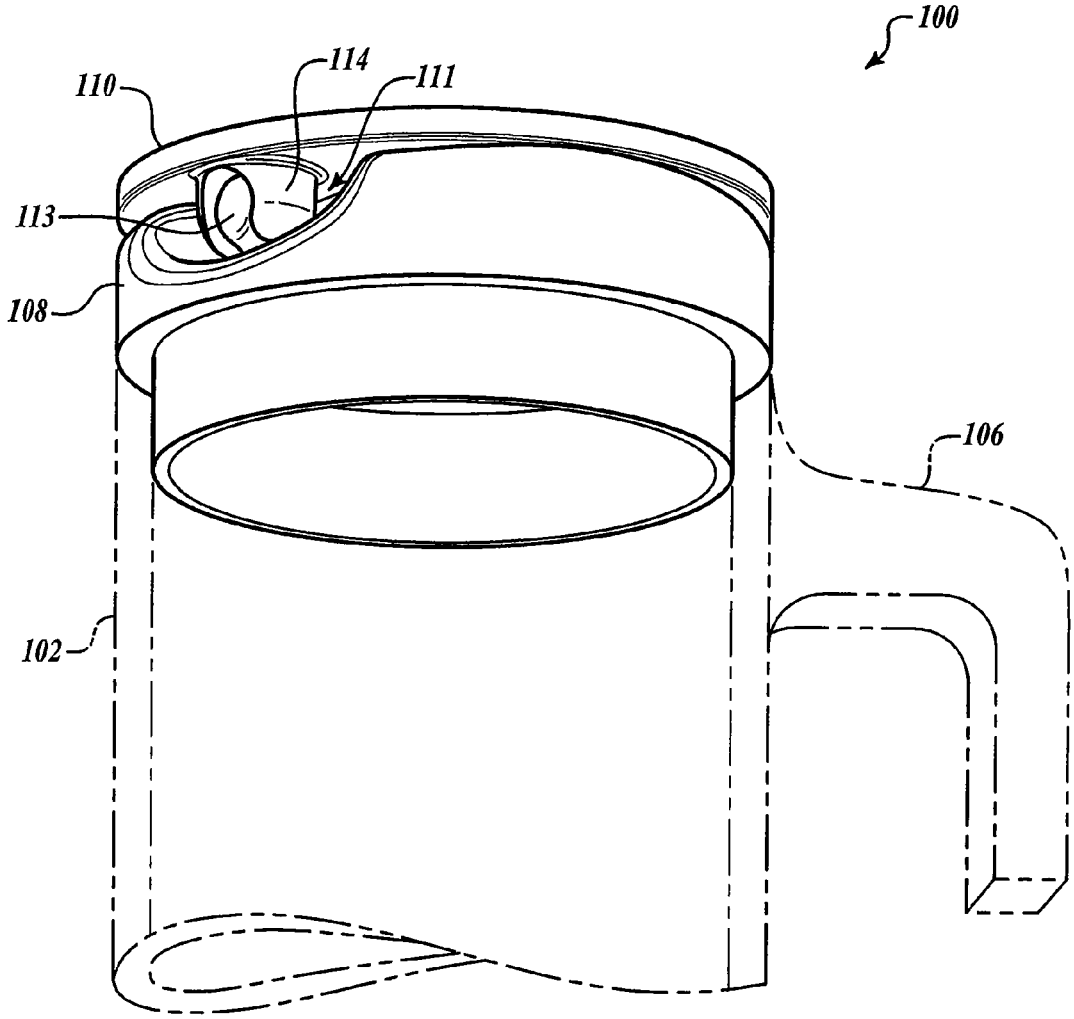
FIG. 1 is an isometric view of a beverage container having a cover assembly comprising a cover rotationally engaged to a cap, the cover polyaxially rotatable with respect to the cap, and the cover in a closed position.

FIG. 1 shows a beverage container generally indicated at reference numeral 100 having a receptacle or vessel 102 and a cover assembly generally indicated at reference numeral 104 in the various figures of the attached drawings in which numbered elements in the figures correspond to like numbered elements herein. The receptacle 102 includes a handle 106 attached to an outer wall of the receptacle 102. In one embodiment, the receptacle 102 is an insulated travel mug that reduces the rate of temperature change of a liquid within the receptacle 102. The cover assembly 104 includes a vessel lid or cap 108 and an associated cover 110. The cap 108 may be a separate component coupled to the receptacle 102 or may be integrally formed or molded with the receptacle 102. In either embodiment, the cover assembly 104 includes a socket assembly generally indicated at reference numeral 111.

In brief, the ball and socket assembly 111 includes a ball member 113 and a socket member 114. In the preferred embodiment, the ball member 113 is formed as part of and located at a distal edge of the cap 108 while the socket member 114 is formed as part of the cover 110. In another embodiment (not shown), the ball member 113 is formed as part of the cover 110 while the socket member 114 is formed as part of the cap 108. In either embodiment, the ball member 113 is rotationally received by or engaged by a socket member 114 to allow the cover 110 to rotate polyaxially relative to the cap 108.

Figure 2:
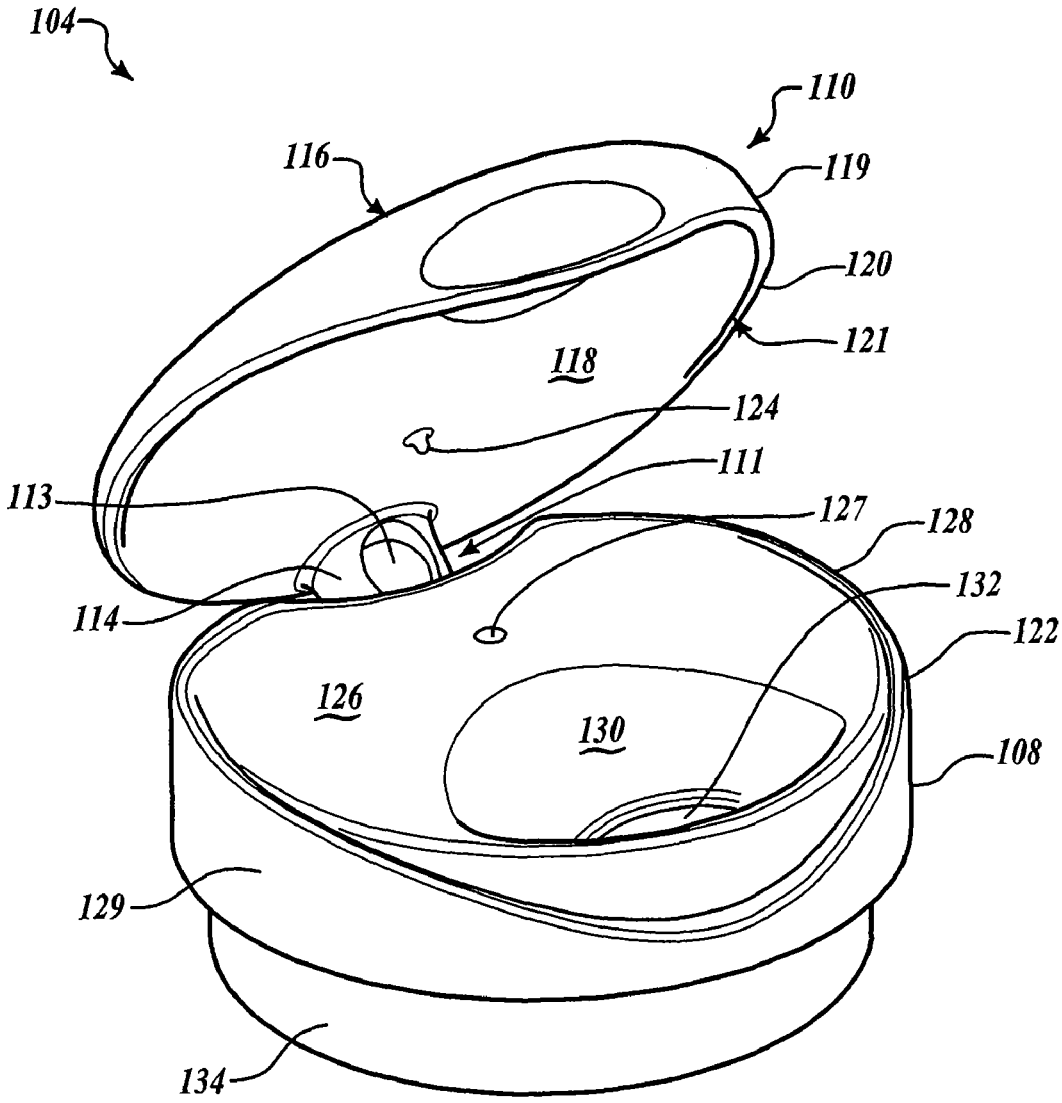
FIG. 2 is an isometric view of the cover assembly of FIG. 1 with the cover in an open position.

FIG. 2 shows the cover assembly 104 in an open position. The cover 110 includes an upper surface 116 spaced apart from a lower surface 118. A perimeter edge section 119 having a rim surface 120 extends at least partially, circumferentially around the cover 110. A bottom portion of the rim surface 120 operates as a bearing or contact surface 121, which in turn is complementarily contoured with respect to a corresponding lip surface 122 of the cap 108. In addition, the cover includes a protuberance or detent 124 that extends or projects from the lower surface 118. The detent 124 operates to engage and may seal a vent opening 127 in the cap 108 when the cover 110 is moved to a closed position. In one embodiment, the detent 124 is sized to have a slight interference fit with the opening 127, which functions as a vent to release steam and/or pressure from the receptacle 102. The vent opening 127 operates to equalize pressure within the receptacle 102 when a user drinks from the beverage container 100.

The cap 108 includes a first basin 126 that slopes downward from a lip 128 toward and into a deeper, second basin 130. The lip 128 is formed as part of a sidewall 129 of the cap 108. The first basin 126 is contoured and sized to help reduce spillage of the liquid in the receptacle 102 if the receptacle 102 is tipped or tilted. The second basin 130 slopes downward toward a drinking opening 132, which is in fluid communication with the receptacle 102 (see FIG. 1). In the preferred embodiment, the slope of the first basin 126 is shallower or not as deep compared to the second basin 130. In another embodiment (not shown), the first basin slopes downward toward the drinking opening 132, such that there is no need for the second basin 130. In addition to the above features, the cap 108 includes an engagement portion 134 to engage with the receptacle 102. In one example, the engagement portion 134 is threaded to complementarily engage the receptacle 102 (see FIGS. 3 and 4). In another embodiment (not shown), the engagement portion 134 is sized to have a slight interference fit (e.g., a frictional fit) with a corresponding opening in the receptacle 102. In addition to these examples, other embodiments may include other methods or configurations for coupling the cap 108 to the receptacle 102 that are known to those of ordinary skill in the relevant art.

Figure 3:
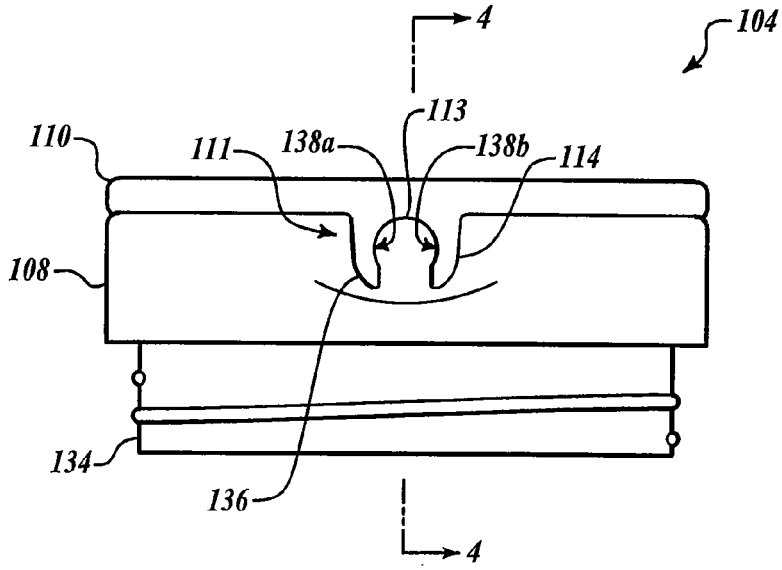
FIG. 3 is a rear side view of the cover assembly of FIG. 2.

FIG. 3 shows the cover 110 in the closed position where the rim surface 120 of the cover 110 seats against or is in substantial contact with the lip surface 122 of the cap 108 so as to present a low profile to a user. In the preferred embodiment, the rim 120 operates to limit, restrict, or prevent splashing of a liquid that may be in one of the first basin 126 or the second basin 128.

The ball and socket assembly 111 permits cooperation between the ball member 113 and the socket member 114 so that the cover 110 is polyaxially rotatable with respect to the cap 108 and/or with respect to the receptacle 102. In the illustrated embodiment, the socket member 114 includes a pair of spaced apart arms 136 extending from the lower surface 118 of the cover 110. The arms 136 are biasly separable and include opposing, arcuate surfaces 138*a*, 138*b* for rotationally engaging the ball member 113. In the preferred embodiment, the cover 110 can be rotated upwards away from the first basin 126 of the cap 108 and then compound rotated and placed behind the receptacle 102. When the cover 110 is behind the receptacle 102, the cover 110 is substantially removed from the user's view when drinking from the receptacle 102 and most, if not all, of the cover 110 is positioned below the lip surface 122 of the cap 108. Thus, the polyaxial rotation permitted by the ball and socket assembly 111 advantageously allows the cover 110 to be moved out of the way when drinking while keeping the cover 110 connected to the receptacle 102. Another advantage is that the cover 110, because it remains attached to the cap 108 during use, is less susceptible to being dropped, misplaced, or lost.

Further, as the cover 110 is rotated, an amount of friction between the ball member 113 and the socket member 114 allows the cover 110 to stay in a desired position relative to the cap 108 after the moving force is removed. For example, the user may rotate the cover 110 upward and away from the cap 108 to a slightly open position to allow the liquid in the receptacle to cool. In this example, the amount of friction in the ball and socket assembly 111 would maintain the cover 110 in the slightly open position without any additional assistance or support. In addition to the surface friction between the ball member 113 and the socket member 114, it is appreciated that the flexibility of the arms 136 of the socket member 114 may also operate as one of the design parameters for controlling the ease with which the cover 110 can be rotated relative to the cap 108. By way of example, the arms 136 are elastically bendable by an amount sufficient to release the ball member 113 and then spring back to their original configuration. In one embodiment, the flexibility of the arms 136 of the socket member 114 and/or the amount of friction in the ball and socket assembly 111 is sufficient to permit the cover 110 to be removed and replaced from the cap 108 for the purpose of cleaning.

Figure 4:
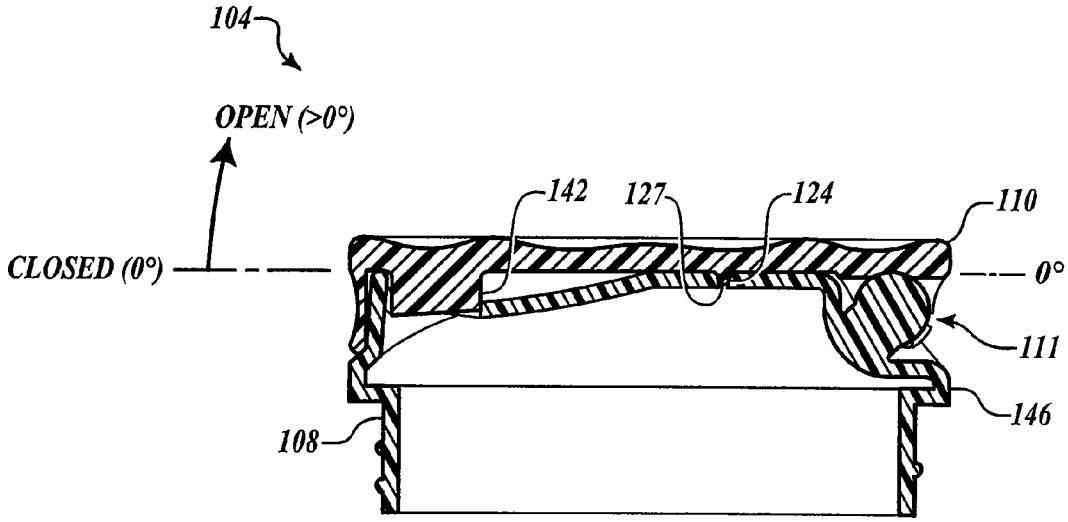
FIG. 4 is cross-sectional view of the cover assembly of FIG. 2 taken along line 4-4 of FIG. 3.

FIG. 4 shows the cover assembly 104 with the cover 110 in the closed position relative to the cap 108 as contrasted to one of the open positions exemplarily illustrated in FIG. 2. In the open position, the rim 120 of the cover 110 is at least slightly spaced apart from the lip surface 122 of the cap 108. The closed position, by contrast, is when the cover 110 is positioned at about zero degrees) (0° relative to the cap 108 as shown in the illustrated embodiment. Hence, the open position includes when the rim surface 120 of cover 110 is rotationally positioned to be spaced apart from the lip surface 122 of the cap 108 by an amount that is greater than 0° (>)0°.

FIG. 4 further shows the detent 124 of the cover 124 received in the opening 127 and a plug member 142 extending from the lower surface 118 of the cover received in the drinking opening 132. The plug member 142 selectively seals the drinking opening 132 against fluid passage between the second basin 130 and the receptacle 102. In addition, the cover 110 includes a front lip 144 that seats against the sidewall 129 of the cap 108 when the cover 110 is in the closed position.

While various embodiments of the invention have been illustrated and described, as noted above, many changes can be made without departing from the spirit and scope of the invention. For example, the cap or beverage container may have the extendable arms comprising the socket member while the cover includes the ball member. In addition, the ball member 113 may be coupled to the cap 108 while the socket member 114 is coupled to the cover 110. Accordingly, the scope of the invention is not limited by the disclosure of the preferred embodiment. Instead, the invention should be determined entirely by reference to the claims that follow.

I claim:

1. A cover for a beverage container comprising:

a cover body having a lower surface disposed from an upper surface and a rim defining a perimeter of at least a portion of the cover body with a contoured forward portion extending transversely to the lower surface at a forward portion of the cover body and having a contour, the cover body having a plug member, the cover body being movable between a closed position and an open position;

a cap member having a first portion coupled to and located below a second portion, the first portion engageable with a receptacle of a beverage container, the second portion having a sidewall extending about a recessed drinking basin with a drinking opening extending through the cap member and sized and positioned to be sealed by the plug member when the cover body is in the closed position, the sidewall having a forward drinking portion adjacent to the drinking basin and extending upwardly above the drinking opening at which a user can drink fluid entering the drinking basin through the drink opening when the cover body is in the open position and upon tilting the beverage container forward, the sidewall having an upper lip surface portion extending at least partially about the sidewall with a contoured forward lip portion positioned below at least a portion of the forward drinking portion and with a contour corresponding to the contour of the contoured forward portion of the rim of the cover body, the contoured forward portion of the rim and the contoured forward lip portion being in juxtaposition with the contoured forward portion of the rim overlapping the forward drinking portion of the sidewall when the cover body is in the closed position, the cover body extending over the drinking basin and the plug member sealing the drinking opening when the cover body is in the closed position, the sidewall having a rearward sidewall portion defining a rearwardly and upwardly opening rear recess at a rearward portion of the cap member; and a rotational coupling mechanism interconnecting the cover body and the cap member for polyaxial rotation of the cap member relative to the cover body when the cover body is at least slightly spaced apart from the upper lip surface of the sidewall of the cap member, the rotational coupling mechanism including an upwardly extending ball member positioned in the rear recess of the cap member rearward of the sidewall of the cap member, and a socket member having a pair of arms with spaced apart end portions having opposing, arcuate surfaces rotationally receiving therebetween the ball member, the arms extending transversely to the lower surface of the cover body into the rear recess of the cap member.

2. The cover assembly of claim 1 wherein the cover body includes a protuberance extending from the lower surface of the cover and wherein the cap member includes a vent opening and the protuberance is sized to seal the vent opening when the cover body is in the closed position.

3. The cover assembly of claim 2 wherein the cover body and cap member are substantially circular in plan view.

4. The cover assembly of claim 1 wherein the contoured forward portion of the rim seats against the contoured forward lip portion when the cover body is in the closed position.

5. The cover assembly of claim 1 wherein the rearward sidewall portion of the cap member defining the rear recess has a lower wall portion and opposing side wall portions extending upward from the lower wall portion, the lower wall portion being positioned sufficiently below the ball member and the side wall portions being sufficiently spaced apart to each side of the ball member to permit rotation of the cover member upward from the closed position to a position with the cap member extending upwardly sufficient to allow the cover member to next be rotated downward to a position adjacent to and behind the beverage container with the cover member extending downward without interference by the lower wall portion or the side wall portions.

6. The cover assembly of claim 1 wherein the drinking basin includes an upper basin portion and a lower basin portion, the lower basin portion being deeper than the upper basin portion and sloping downward toward the drink opening.

7. The cover assembly of claim 6 wherein the upper basin portion is defined by an upper sidewall and the lower basin portion is defined by a lower sidewall, the lower sidewall being steeper than the upper sidewall.

8. The cover assembly of claim 1 wherein the arms are elastically separable to permit the cover body to be completely separated from the cap member.

9. The cover assembly of claim 1 wherein the contoured forward portion of the rim seats against the forward drinking portion of the sidewall when the cover body is in the closed position.

10. A cover for a beverage container comprising:

a cover body having a lower surface disposed from an upper surface and a rim defining a perimeter of at least a portion of the cover body with a forward portion extending transversely to the lower surface at a forward portion of the cover body, the cover body being movable between a closed position and an open position;

a cap member having a first portion coupled to and located below a second portion, the first portion engageable with a receptacle of a beverage container, the second portion having a sidewall extending about a recessed drinking basin with a drinking opening extending through the cap member, the sidewall having a forward drinking portion adjacent to the drinking basin and extending upwardly above the drinking opening at which a user can drink fluid entering the drinking basin through the drink opening when the cover body is in the open position and upon tilting the beverage container forward, the sidewall having an upper lip surface portion extending at least partially about the sidewall with a forward lip portion positioned below at least a portion of the forward drinking portion, the forward portion of the rim and the forward lip portion being in juxtaposition with the forward portion of the rim overlapping the forward drinking portion of the sidewall when the cover body is in the closed position, the cover body extending over the drinking basin when the cover body is in the closed position, the sidewall having a rearward sidewall portion defining a rearwardly and upwardly opening rear recess at a rearward portion of the cap member; and a rotational coupling mechanism interconnecting the cover body and the cap member for polyaxial rotation of the cap member relative to the cover body when the cover body is at least slightly spaced apart from the upper lip surface of the sidewall of the cap member, the rotational coupling mechanism including an upwardly extending ball member positioned in the rear recess of the cap member rearward of the sidewall of the cap member, and a socket member having a pair of arms with spaced apart end portions having opposing, arcuate surfaces rotationally receiving therebetween the ball member, the arms extending transversely to the lower surface of the cover body into the rear recess of the cap member.

11. The cover assembly of claim 10 wherein the forward portion of the rim seats against the forward lip portion when the cover body is in the closed position.

12. The cover assembly of claim 10 wherein the rearward sidewall portion of the cap member defining the rear recess has a lower wall portion and opposing side wall portions extending upward from the lower wall portion, the lower wall portion being positioned sufficiently below the ball member and the side wall portions being sufficiently spaced apart to each side of the ball member to permit rotation of the cover member upward from the closed position to a position with the cap member extending upwardly sufficient to allow the cover member to next be rotated downward to a position adjacent to and behind the beverage container with the cover member extending downward without interference by the lower wall portion or the side wall portions.

13. The cover assembly of claim 10 wherein the drinking basin includes an upper basin portion and a lower basin portion, the lower basin portion being deeper than the upper basin portion and sloping downward into toward the drink opening.

14. The cover assembly of claim 13 wherein the upper basin portion is defined by an upper sidewall and the lower basin portion is defined by a lower sidewall, the lower sidewall being steeper than the upper sidewall.

15. The cover assembly of claim 10 wherein the arms are elastically separable to permit the cover body to be completely separated from the cap member.

16. The cover assembly of claim 10 wherein the forward portion of the rim seats against the forward drinking portion of the sidewall when the cover body is in the closed position.

17. A cover for a beverage container comprising:

a cover body having a lower surface disposed from an upper surface and a rim defining a perimeter of at least a portion of the cover body, the cover body being movable between a closed position and an open position;

a cap member having a first portion coupled to and located below a second portion, the first portion engageable with a receptacle of a beverage container, the second portion having a sidewall extending about a recessed drinking basin with a drinking opening extending through the cap member, the sidewall having a forward drinking portion adjacent to the drinking basin and extending upwardly above the drinking opening at which a user can drink fluid entering the drinking basin through the drink opening when the cover body is in the open position and upon tilting the beverage container forward, the sidewall having an upper lip surface portion extending at least partially about the sidewall with a forward lip portion, the forward portion of the rim and the forward lip portion being in juxtaposition when the cover body is in the closed position, the cover body extending over the drinking basin when the cover body is in the closed position, the sidewall having a rearward sidewall portion defining a rearwardly and upwardly opening rear recess at a rearward portion of the cap member; and a rotational coupling mechanism interconnecting the cover body and the cap member for polyaxial rotation of the cap member relative to the cover body when the cover body is at least slightly spaced apart from the upper lip surface of the sidewall of the cap member, the rotational coupling mechanism including an upwardly extending ball member positioned in the rear recess of the cap member rearward of the sidewall of the cap member, and a socket member having a pair of arms with spaced apart end portions having opposing, arcuate surfaces rotationally receiving therebetween the ball member, the arms extending transversely to the lower surface of the cover body into the rear recess of the cap member.

18. The cover assembly of claim 17 wherein the rearward sidewall portion of the cap member defining the rear recess has a lower wall portion and opposing side wall portions extending upward from the lower wall portion, the lower wall portion being positioned sufficiently below the ball member and the side wall portions being sufficiently spaced apart to each side of the ball member to permit rotation of the cover member upward from the closed position to a position with the cap member extending upwardly sufficient to allow the cover member to next be rotated downward to a position adjacent to and behind the beverage container with the cover member extending downward without interference by the lower wall portion or the side wall portions.

19. The cover assembly of claim 17 wherein the drinking basin includes an upper basin portion and a lower basin portion, the lower basin portion being deeper than the upper basin portion and sloping downward toward the drink opening.

20. The cover assembly of claim 19 wherein the upper basin portion is defined by an upper sidewall and the lower basin portion is defined by a lower sidewall, the lower sidewall being steeper than the upper sidewall.

* * * * *